United States Patent [19]

Culkin

[11] 3,940,877

[45] Mar. 2, 1976

[54] CONSTRUCTION TOY HAVING STUFFED PARTS OF SOFT MATERIALS

[76] Inventor: Josephine H. Culkin, 65 Eustis St., Cambridge, Mass. 02140

[22] Filed: Aug. 5, 1974

[21] Appl. No.: 494,980

[52] U.S. Cl. ..... 46/17; 46/22

[51] Int. Cl.[2] ..... A63H 33/00

[58] Field of Search ..... 46/16, 17, 22, 153, 158, 46/159, 151

[56] References Cited

UNITED STATES PATENTS

| | | | |
|---|---|---|---|
| 1,379,013 | 5/1921 | Goss | 46/159 |
| 1,431,482 | 10/1922 | Overholt | 46/153 |
| 1,828,765 | 10/1931 | Crist | 46/159 |
| 2,450,326 | 9/1948 | Berger et al. | 46/22 |
| 2,952,094 | 9/1960 | Ebel | 46/22 X |
| 3,144,375 | 8/1964 | Day | 161/24 |
| 3,445,957 | 5/1969 | Spahr | 46/151 |
| 3,800,436 | 4/1974 | Matzek | 46/22 X |

FOREIGN PATENTS OR APPLICATIONS

| | | | |
|---|---|---|---|
| 583,408 | 12/1946 | United Kingdom | 46/151 |

*Primary Examiner*—F. Barry Shay
*Attorney, Agent, or Firm*—Charles S. McGuire

[57] ABSTRACT

A stuffed toy designed to simulate a composite real-world object having a number of constituent parts. Each part is formed as a separate element of cloth enclosing a resilient stuffing material. At least one of the elements has a plurality of loops affixed thereto and other elements include integral portions for selective insertion through the loops, thereby releasably attaching the elements in such relationship as to form the composite object. Only soft materials are used. The elements are so constructed that small children can assemble and disassemble the objects, and preferred objects are those occurring in nature such as trees, flowers, birds, and the like.

4 Claims, 6 Drawing Figures

CONSTRUCTION TOY HAVING STUFFED PARTS OF SOFT MATERIALS

BACKGROUND OF THE INVENTION

The present invention relates to toys and, more specifically, to stuffed toys of a modular nature which can be selectively assembled and disassembled by small children.

It is a principal object of the invention to providing interesting and durable toys which may be used by small children with no possibility of injury to the child. A further object is to provide stuffed toys having educational value and offering manual manipulative training for small children.

Another object is to provide modular toys comprising a number of three-dimensional elements, each of cloth stuffed with a resilient stuffing material, which may be assembled by small children to form a composite toy simulating an object or combination of objects occurring in nature.

Other objects will in part be obvious and will in part appear hereinafter.

SUMMARY OF THE INVENTION

In accordance with the foregoing objects, the invention comprises a plurality of separate pieces, each fabricated in the nature of a stuffed toy. That is, a suitable material such as a cloth fabric is cut and stitched according to a predetermined design to form a hollow enclosure having an opening for insertion of a resilient stuffing material. The stuffing is packed to the desired density within the formed enclosure and the opening is stitched closed.

The various pieces of the toy are formed with cooperatively mating portions so that they may be assembled by insertion of one part of a secondary piece through an opening provided therefor in or on a base piece. The opening may be formed directly in the base piece as, for example, a hole passing therethrough, or in the nature of a loop formed from a length of material attached at both ends to the base piece. In either case, the elements are releasably secured in a simple manner, easily performed by a small child, to form a composite object of a type encountered in nature. For example, the base piece may be a stuffed member simulating a tree trunk, and the secondary pieces may be stuffed toys simulating limbs, leaves and/or birds having portions engaged through loops on the base.

DETAILED DESCRIPTION

Figure 1:
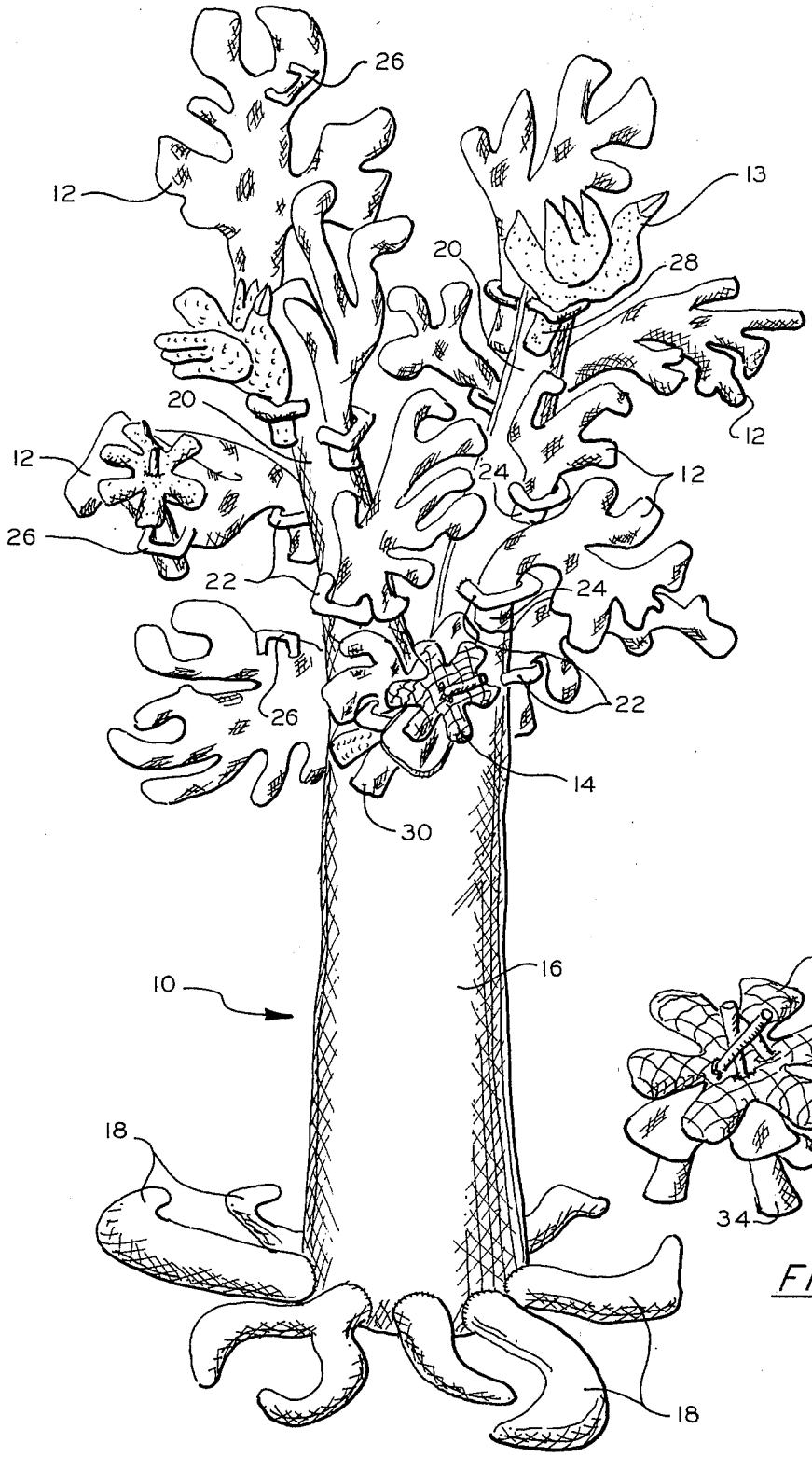
FIG. 1 is a perspective view of an assembled stuffed toy exemplifying one form of the invention.

Referring now to the drawings, in FIG. 1 is shown a stuffed toy fabricatd according to the present invention and including base member 10, secondary members 12 and tertiary members 13 and 14. Each of members 10, 12, 13 and 14 is formed in the nature of a stuffed toy according to conventional techniques. That is, one or more pieces of flexible material, preferably a cloth fabric of natural or synthetic material, are cut to a predetermined shape and sewn or otherwise attached along marginal edges to form a hollow enclosure. Normally, the cloth enclosure is then turned inside out so that the marginal edges are on the inside. A resilient material, preferably nonallergenic, fire-resistant, polyester batting, is stuffed into the enclosure and packed to a desired density. The enclosure is then fully closed by stitching or otherwise permanently sealing the opening through which the stuffing is inserted.

Member 10, as seen in FIG. 1, simulates in appearance the base of a tree, including trunk 16, roots 18 and branches 20, all being stuffed in the aforementioned manner with the density of the stuffing being such that member 10 is self-supporting when resting with roots 18 on a flat support surface. A plurality of loops 22 are affixed to member 10, in this case to the upper portions thereof. Loops 22 may be formed integrally with base 10, but are preferably formed separately of a length of material stitched at each end to the base at selected locations. Loops 22 may be elastic in nature, or may comprise stuffed cloth enclosures of the same general type as the other members.

Members 12, 13 and 14 simulate the appearance of stylized tree branches, birds and blossoms. End portions 24 of members 12 are formed for insertion through loops 22. When so inserted, members 12 are so positioned and dimensioned relative to base 10 that the composite object formed by combination thereof in the manner indicated simulates the appearance of a tree with limbs and branches, the appearance being enhanced by forming members 10 and 12 of brown and green material, respectively.

Loops 26 are formed and affixed to members 12 in the same manner as loops 22 and member 10. End portions 28 and 30 of members 13 and 14, respectively, are formed for insertion through loops 26 so that the birds and blossoms simulated thereby are supported upon members 12. In the illustrated embodiment, loops 22 and 26 form openings of substantially the same size, whereby end portions 24, 28 and 30 of the respective members are of substantially the same proportions. Thus, if desired, members 13 and 14 may be engaged through loops 22 on base member 10, or members 12 may be affixed to one another to form larger simulated branches. Alternatively, loops 26 may define openings of a different size than loops 22, with end portions 24 shaped to fit only loops 22 and end portions 28 and 30 only loops 26.

Figure 3:
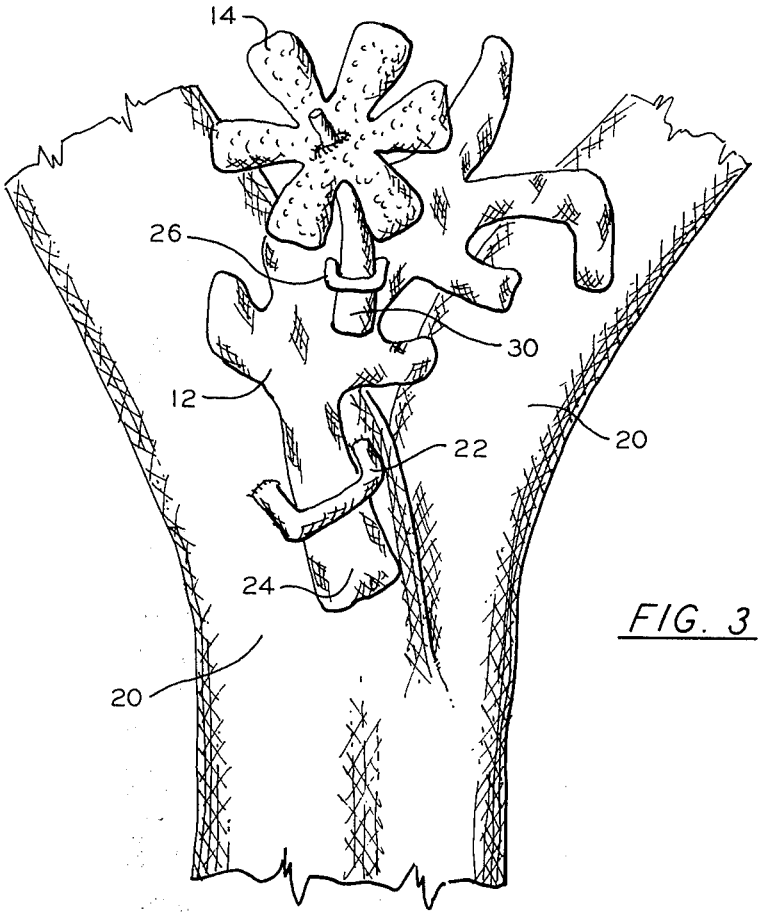
FIG. 3 is a fragmentary, perspective view of a portion of the toy of FIG. 1.

Various elements of the composite object of FIG. 1 may be seen more clearly in the somewhat enlarged fragmentary view of FIG. 3.

Figure 2:
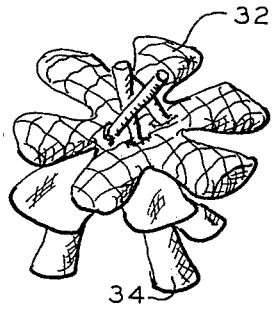
FIG. 2 is a perspective view of another stuffed toy showing a further form of the invention.

In FIG. 2 is shown another composite object, in the nature of a flower, formed by selective assembly of a number of constituent parts each formed as a stuffed element in the manner previously described. The petals, or bloom portion of the flower is formed as a single element, denoted by reference numeral 32. Portion 32 is supported by a plurality of other stuffed elements 34, which are of substantially identical configuration, simulating stems at the lower end and portions of the bloom at the upper end. The elements beneath portion 32 in FIG. 2 are formed in the nature of leaves and also include openings (not shown) through which elements 34 pass. In this embodiment, portion 32 may be considered the base member, elements 34 the secondary members, and the leaf elements shown under element 32 additional secondary or tertiary members.

Figure 4:
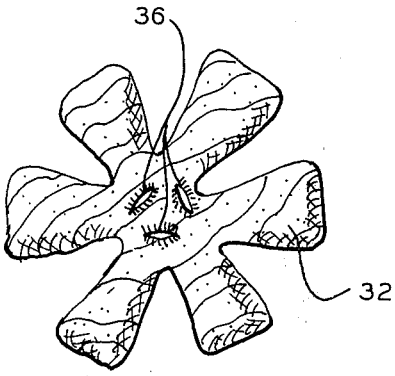
FIGS. 4 and 5 are elevational views of individual elements of the toys shown in FIG. 2.
Figure 5:
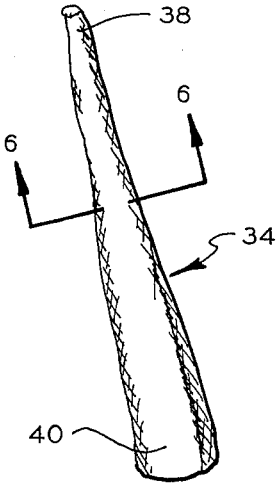

Elements 32 and 34 are shown separately in FIGS. 4 and 5. Element 32 is provided with openings 36, stitched around their peripheries, for accepting small ends 38 of elements 34. The composite object is supported on large ends 40 of elements 34 when assembled as shown in FIG. 2. Small ends 38 extend through the upper side of elements 32 to appear as the stamen portion of the flower. The size of openings 36 is such, relative to the size of the opposite ends of elements 34, that only ends 38 of the latter may be placed through the openings.

Figure 6:
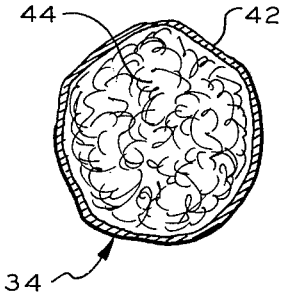
FIG. 6 is a sectional view taken on the line 6-6 of FIG. 5.

In FIG. 6, the sectional view of portion 34 shows the outer covering 42, of cloth fabric or other flexible material suitable for such use, and resilient stuffing 44 with which the compliant form is filled.

What is claimed is:

1. A modular, three dimensional toy kit having only relatively soft members for selective assembly and disassembly by small children, said kit comprising:

a. a base member of cloth covering filled with resilient stuffing material and shaped to represent a first portion of a real-world object:

b. a plurality of secondary members of cloth covering filled with resilient stuffing material and shaped to represent second portions of said real-world object; and c. means for attaching said secondary members to said base member, said means consisting solely of a plurality of loops of cloth material attached to selected points to said base member and integral portions of said secondary members, each said integral portion forming a simulated part of said real-world object, the relative sizes of said loops and said integral portions being such that said secondary members are secured to said base member by insertion of said integral portions through said loops.

2. The invention according to claim 1 wherein said loops are formed of a cloth covering filled with resilient stuffing material.

3. The invention according to claim 1 wherein said base member is of substantially greater height than its width and thickness, and the density of said stuffing material is such that said base member is self supporting.

4. The invention according to claim 3 wherein said first portion comprises a tree trunk and said second portions comprise tree limbs.

* * * * *